US007057471B2

(12) United States Patent
Sakai

(10) Patent No.: US 7,057,471 B2
(45) Date of Patent: Jun. 6, 2006

(54) NON-RECIPROCAL DEVICE

(75) Inventor: Minoru Sakai, Tokyo (JP)

(73) Assignee: TDK Corporation, Tokyo (JP)

( * ) Notice: Subject to any disclaimer, the term of this patent is extended or adjusted under 35 U.S.C. 154(b) by 29 days.

(21) Appl. No.: 10/997,942

(22) Filed: Nov. 29, 2004

(65) Prior Publication Data

US 2005/0134397 A1 Jun. 23, 2005

(30) Foreign Application Priority Data

Nov. 28, 2003 (JP) ..... 2003-400420

(51) Int. Cl.
*H01P 1/383* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,222,425 B1 * 4/2001 Okada et al. ..... 333/1.1

FOREIGN PATENT DOCUMENTS

| | | |
|---|---|---|
| JP | 56-20322 | 2/1981 |
| JP | 56-24815 | 3/1981 |
| JP | 10-327003 | 12/1998 |
| JP | 11-239009 | 8/1999 |
| JP | 3201279 | 6/2001 |
| JP | 3278105 | 2/2002 |
| WO | WO 00/59065 | 10/2000 |

* cited by examiner

*Primary Examiner*—Stephen E. Jones
(74) *Attorney, Agent, or Firm*—Oblon, Spivak, McClelland, Maier & Neustadt, P.C.

(57) ABSTRACT

The present invention is directed to a non-reciprocal device whose use makes it possible to reduce the insertion loss, and the size and thickness of its body, and broaden the frequency band treated by it. The DC magnetic field is adjusted such that, in a Smith chart where the center O1 represents the normalized impedance, the impedance of the gyromagnetic component 2 is positioned at a value which is on a constant conductance circle smaller than the reference constant conductance circle EC0 passing the center O1 and which is on a constant reactance line above the reference constant reactance line EX0 passing the center O1. Inductor L11 or L12 has one end connected to a terminal of the center conductor such that in the Smith chart, the impedance of the gyromagnetic component 2 seen from the other end of the inductor L11 or L12 is positioned at a value which is on the reference constant conductance circle EC0 passing the center O1. First capacitor C21 or C22 is connected, in parallel with the center conductor, to the other end of the inductor L11 or L12 such that in the Smith chart, the impedance of the gyromagnetic component 2 seen through the inductor from the connection point of the first capacitor is positioned at a value which is on the center O1.

4 Claims, 9 Drawing Sheets

PRIOR ART

PRIOR ART

NON-RECIPROCAL DEVICE

TECHNICAL FIELD

The present invention relates to a non-reciprocal device such as an isolator, circulator, etc.

BACKGROUND OF THE INVENTION

A non-reciprocal device such as an isolator or circulator is incorporated, for example, in a mobile wireless communication device such as a mobile telephone set. A typical non-reciprocal device comprises magnetic components such as a gyromagnetic component formed from a soft ferrite body and center conductors and a permanent magnet, and electric components such as a matching capacitor and a terminal resistance, all housed in a magnetic-metal case functioning as a yoke.

The center conductors are combined with the soft ferrite body, and to the assembly is applied a DC magnetic field by the permanent magnet. Each of the center conductors has one end placed on one surface of the soft ferrite body to be connected to the metal case serving as a grounding part to be grounded, and the other end arranged on the other surface of the soft ferrite body such that the conductors are insulated from each other and intersect with each other on the other surface of the soft ferrite body with a specified angle between adjacent conductors. The other end of each center conductor serves as a terminal for external connection.

Demand for the compaction of a non-reciprocal device as described above is limitless because the smaller a non-reciprocal device is, the higher marketability it can command. In response to this demand, attempts have been made with efforts mainly directed to the compaction and thinning of the soft ferrite body. Indeed, the soft ferrite body currently available comes to have a size as small as a square with a side of 4 mm or less. On the other hand, users of mobile telephone sets are increasing, and dual band sets are being brought to the market. These tendencies require not only the broadening of frequency bands applicable to this type of wireless communication, but also the broadening of frequency bands treated by a non-reciprocal device incorporated in a mobile telephone set used for such wireless communication. However, if the soft ferrite body is made small beyond a certain limit, the center conductor will have a too small inductance which will narrow the frequency band treatable otherwise compensated. If the inductance of the center conductor is too small, it is necessary, in order to achieve impedance matching, to increase the intensity of a magnetic field applied to the center conductor which in turn requires the soft ferrite body to be thickened.

As seen from above, compaction of a soft ferrite body is in opposite relation with broadening of the frequency band treatable by a non-reciprocal device incorporating the soft ferrite body. Proposals have been offered for broadening the frequency band treatable by a non-reciprocal device, and they include, for example, attachment of an impedance modifying circuit or resonant circuit to the non-reciprocal device.

Specifically, reissued patent publication WO 00/59065 discloses a technique for broadening the frequency band of a matching network by attaching an impedance modifying circuit to the input/output terminal of a lumped reciprocal element. The same invention further discloses a process including producing a laminated ceramic body by low-temperature simultaneous firing which represents an inductance and electrostatic capacitance of the impedance modifying circuit, and a load capacitance inherent to the lumped reciprocal element, and introducing the laminated ceramic body into a non-reciprocal device.

JP, H11-239009, A discloses a technique for broadening the frequency band of a non-reciprocal device with a single peak characteristic curve by modifying the element in such a manner as to allow it to have a dual peak characteristic curve. Specifically, the technique consists of connecting a resonant circuit to a grounding terminal of the non-reciprocal device, and the invention also discloses a circuit board on which the resonant circuit is mounted together with the non-reciprocal device and other circuit components.

In JP, S56-20322, A and JP, S56-24815, A, a scheme for broadening the frequency band treatable by a non-reciprocal device is disclosed that consists of attaching an element comprising an inductor and capacitor connected in series to a terminal of the non-reciprocal device, and inserting another capacitor between the connection point of the inductor and capacitor, and ground.

Broadening the frequency band treatable by a non-reciprocal device by attaching an impedance modifying circuit or resonant circuit to the non-reciprocal device described above, however, requires the deliberate introduction of an electrostatic capacitance in addition to a matching capacitance inherent to the non-reciprocal device. Introduction of an impedance modifying circuit or resonant circuit into a non-reciprocal device does not reduce the capacitance required for the inherent matching capacitor. Thus, addition of an impedance modifying circuit or resonant circuit requires the institution of an additional space in the non-reciprocal device for accepting the additional circuit, which may seriously interfere with the attempt to reduce the size or thickness of the non-reciprocal device.

SUMMARY OF THE INVENTION

The object of the present invention is to provide a non-reciprocal device which can reduce the insertion loss, enables compaction and thinning, and can treat a broad frequency band.

To fulfill the above object, a non-reciprocal device of the present invention comprises a gyromagnetic component, a permanent magnet and at least two LC circuits. The gyromagnetic component comprises a soft ferrite body and a plurality of center conductors combined with the soft ferrite body.

The permanent magnet applies a DC magnetic field to the gyromagnetic component, the intensity of the DC magnetic field adjusted such that, in a Smith chart where the center represents the normalized impedance, the impedance of the gyromagnetic component is positioned at a value which is on a constant conductance circle smaller than a reference constant conductance circle passing the center and which is on a constant reactance line above a reference constant reactance line passing the center.

The LC circuits are provided for each of the at least two center conductors, and each of the LC circuits comprises an inductor and a first capacitor.

The inductor is connected in series with the center conductor, one end of the inductor connected to a terminal of the center conductor, such that in the Smith chart, the impedance of the gyromagnetic component seen from the other end of the inductor is positioned at a value which is on the reference constant conductance circle.

The first capacitor is connected, in parallel with the center conductor, to the other end of the inductor such that in the Smith chart, the impedance of the gyromagnetic component seen through the inductor from the connection point of the first capacitor is moved from the value positioned by the inductor, clockwise on the reference constant conductance circle and is positioned at a value which is on the center.

In the non-reciprocal device of the present invention, the intensity of the DC magnetic field, which is applied by the permanent magnet to the gyromagnetic component, is adjusted such that, in a Smith chart where the center represents the normalized impedance, the impedance of the gyromagnetic component is positioned at a value which is on a constant conductance circle smaller than the reference constant conductance circle passing the center and which is on a constant reactance line above the reference constant reactance line passing the center. This allows the permanent magnet to have a lowered magnetic field and resultant reduced thickness, in comparison with a conventional non-reciprocal device in which the magnetic field is adjusted such that the impedance of the gyromagnetic component is positioned at a value on the reference constant conductance circle passing the center.

The LC circuits are provided for each of the at least two center conductors, and each of the LC circuits comprises an inductor and a first capacitor. The inductor is connected in series with the center conductor, one end of the inductor connected to a terminal of the center conductor, such that in the Smith chart, the impedance of the gyromagnetic component seen from the other end of the inductor is positioned at a value which is on the reference constant conductance circle.

The first capacitor is connected, in parallel with the center conductor, to the other end of the inductor such that in the Smith chart, the impedance of the gyromagnetic component seen through the inductor from the connection point of the first capacitor is moved from the value positioned by the inductor, clockwise on the reference constant conductance circle and is positioned at a value which is on the center.

Thus, the impedance seen from the input/output terminals of the non-reciprocal device is set at the center of the Smith chart, and impedance matching is achieved, thereby reducing insertion loss.

Moreover, even if a small, soft ferrite body is employed, it is possible to maintain the impedance of the center conductor at a sufficiently high level, and thus to broaden the operable frequency band.

Furthermore, the capacitor connected in parallel with the center conductor is allowed to have a reduced capacitance and so, that capacitor is reduced in size. In conclusion, according to the invention, it is possible to reduce the size and thickness of a non-reciprocal device by reducing the sizes of the in-parallel capacitor and soft ferrite body, and thinning the permanent magnetic body.

The non-reciprocal device of the present invention may further comprise a plurality of second capacitors. The second capacitors are equivalent to balancing capacitors in a conventional non-reciprocal device in which the balancing capacitors are inserted between terminals of the center conductors and ground. Each of the second capacitors is adjusted such that in the Smith chart, the impedance of the gyromagnetic component seen from the connection point of the second capacitor is moved clockwise on a constant conductance circle and is positioned at a value which is on a constant reactance line above the reference constant reactance line. The inductor of the LC circuit is adjusted such that in the Smith chart, the impedance of the gyromagnetic component is moved from the value positioned by the second capacitor and is positioned at a value which is on the reference constant conductance circle.

As described above, according to the present invention, a non-reciprocal device is provided which can reduce the insertion loss, enables compaction and thinning, and can treat a broad frequency band.

The specification also discloses a non-reciprocal device having a LC circuit formed of a distributed constant line. The other objects, constitutions and advantages of the present invention will be further detailed below with reference to attached drawings. The embodiments shown in the drawings, however, are presented only for illustrative purposes.

DESCRIPTION OF THE PREFERRED EMBODIMENTS

Figure 1:
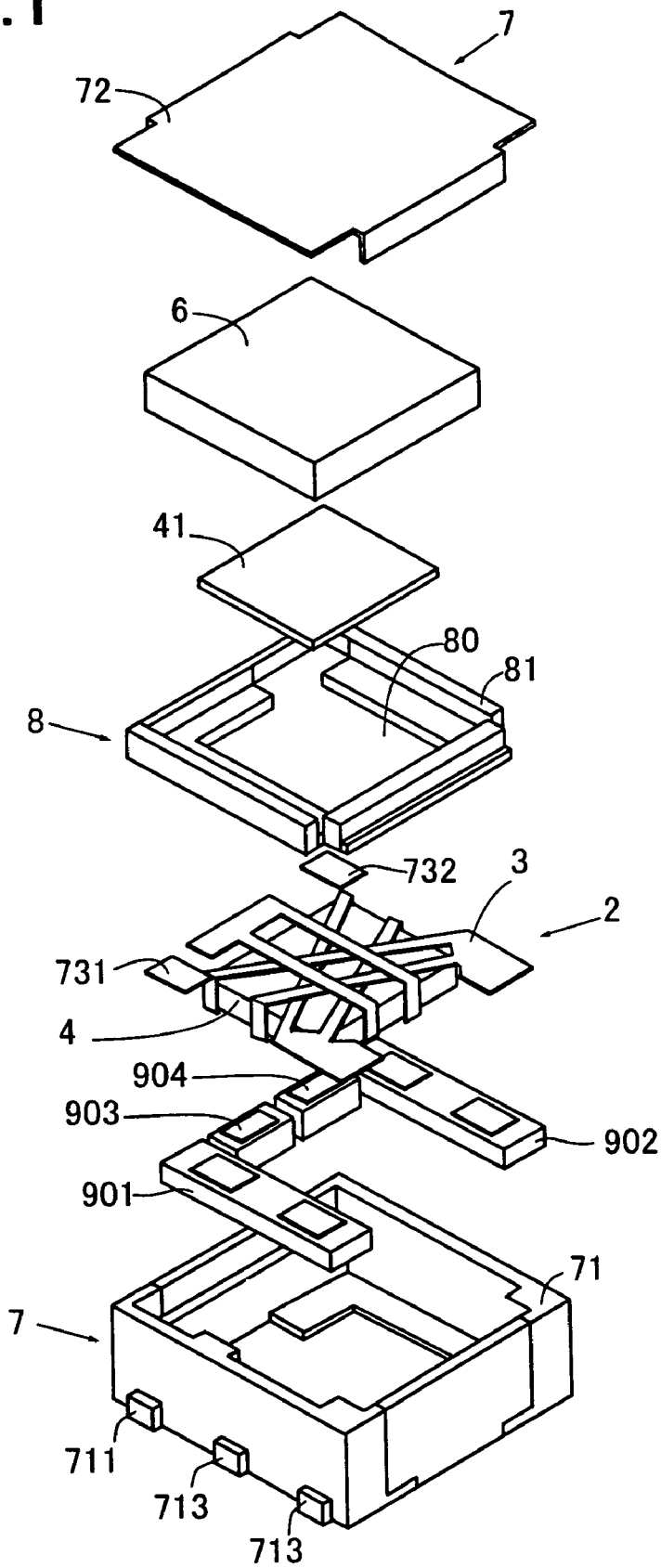
FIG. 1 is a perspective view of a non-reciprocal device representing an embodiment of the invention with its components disintegrated for illustration.
Figure 2:
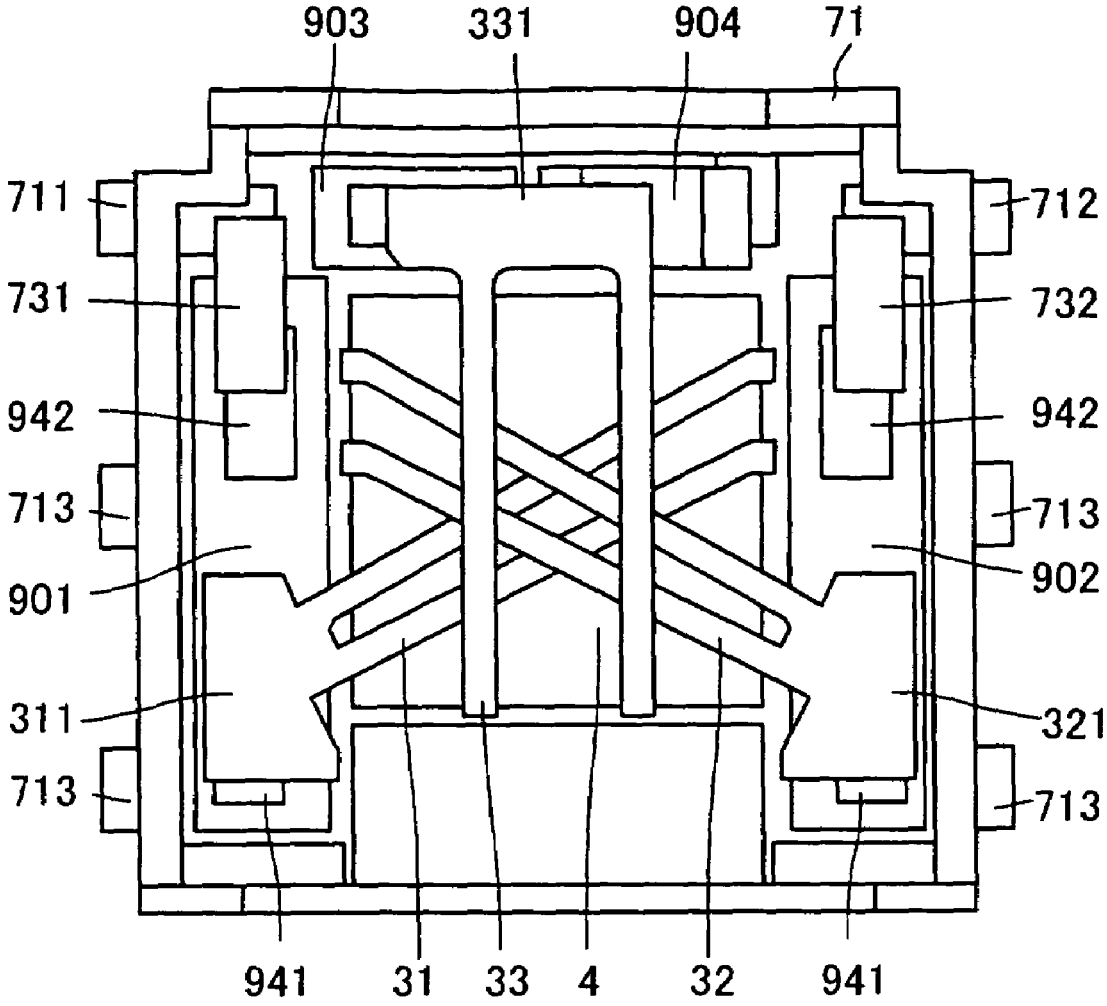
FIG. 2 is a flat view of the non-reciprocal device shown in FIG. 1 for illustrating how a gyromagnetic component is assembled.
Figure 3:
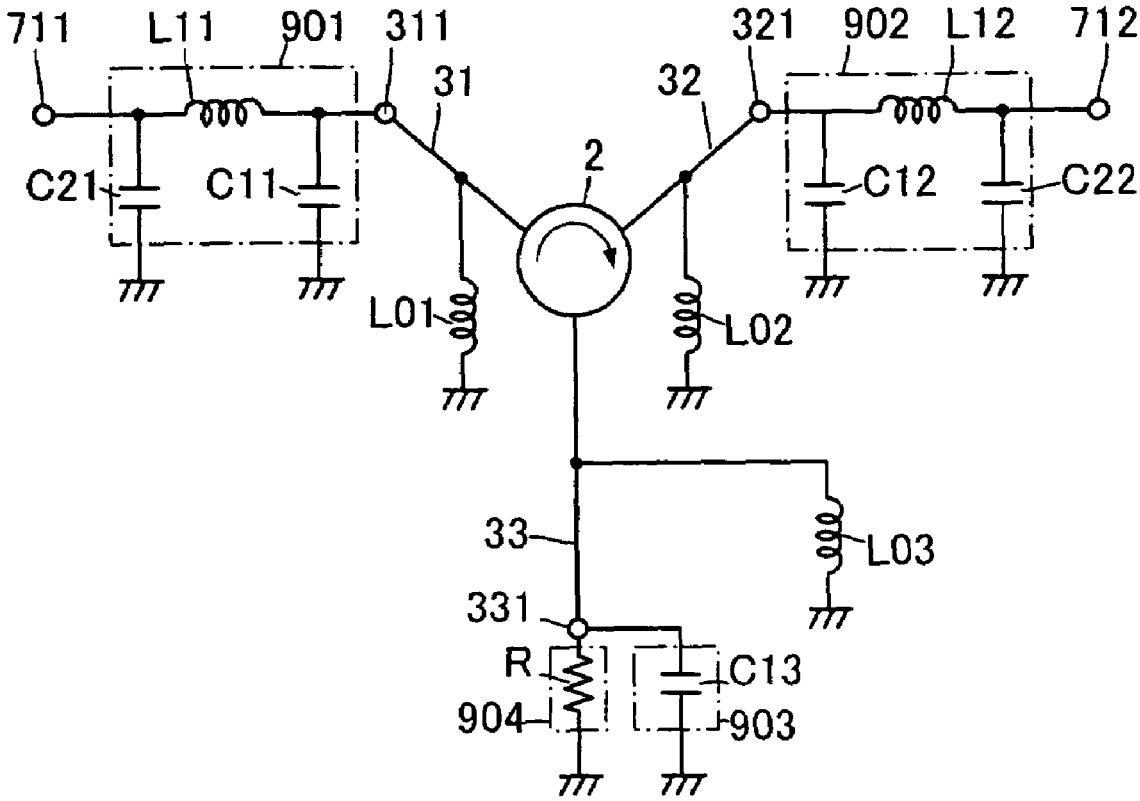
FIG. 3 is the circuit diagram of the non-reciprocal device shown in FIGS. 1 and 2.

FIG. 1 is an exploded perspective view of a non-reciprocal device embodying the invention, FIG. 2 is a flat view of a gyromagnetic component of the non-reciprocal device shown in FIG. 1 for illustrating its assemblage, and FIG. 3 is the circuit diagram of the non-reciprocal device shown in FIGS. 1 and 2.

The non-reciprocal device 1 shown in the figures comprises a gyromagnetic component 2, a permanent magnet 6, a case 7, a pressing member 8, and electric components 901, 902, 903, 904.

The case 7 comprises an enclosure member 71 and a lid member 72. The enclosure member 71 comprises electrically conductive magnetic metal partitions and insulating resin partitions, has a shape like a box whose top is open, and has its bottom grounded (ground G potential). Each of the insulating partitions has terminals 711–713 for connecting internal circuit elements with external circuit elements. The enclosure member 71 houses the gyromagnetic component 2, permanent magnet 6, electric components 901–904, and pressing member 8 within its internal space. The lid member 72 is made of an electrically conductive magnetic metal material, is laid over the permanent magnet 6, and, when combined with the enclosure member 71, closes the open top of the latter to be magnetically coupled with the permanent magnet to act as a yoke of the latter.

The gyromagnetic component 2 includes a center conductor 3 comprising a plurality of center conductors, a soft ferrite body 4, and an insulating sheet 5.

The soft ferrite body 4 is preferably made of a soft magnetic material such as yttrium/iron/garnet (YIG) or the like. The soft ferrite body 4 is shaped like a flat square having a side of several millimeters and a thickness of 0.1–1.0 mm.

The center conductor 3 comprises first to third center conductors 31 to 33, and each of the conductors is made of an appropriately shaped conductor plate obtained, for example, by punching a copper plate having a thickness of 30–50 μm. In the particular embodiment shown in the figures, the center conductors roll their bifurcated limbs around the three sides of the soft ferrite body 4 and contact with its bottom surface or the square-shaped grounded portion. The first to three center conductors 31 to 33 are folded one over another being insulated from each other on the top surface of the soft ferrite body 4 such that they intersect with each other there to form a specified angle between adjacent conductors. The particular embodiment shown in the figures further includes a second soft ferrite body 41.

The pressing member 8 is made of an insulating material such as engineering plastic, and comprises a cavity portion 80 and a frame portion 81. The cavity portion 80 is for receiving the permanent magnet 6. The frame portion 81, when it receives electric components 901–904, gyromagnetic component 2 and permanent magnet 6 in its space, makes them stabilized in their respective places. The permanent magnet 6 is for applying a DC magnetic field to the gyromagnetic component 2.

According to the non-reciprocal device embodying the invention, the electric component 901 is an LC circuit comprising an inductor L11, a second capacitor C11, and a first capacitor C21 as shown in FIG. 3. The electric component 902 is an LC circuit comprising an inductor L12, a second capacitor C12, and a first capacitor C22. The electric component 903 comprises a second capacitor C13. The electric component 904 comprises a terminal resistor R. The inductor L11 of electric component 901 and the inductor L12 of electric component 902 form distributed-element transmission lines although they are shown to be the components of lumped elements in the figure.

According to this embodiment, the electric components 901 and 902 including their inductors L11 and L12, second capacitors C11 and C21, and first capacitors C21 and C22 are integrally formed on a laminated low temperature co-fired ceramic substrate 9.

Figure 4:
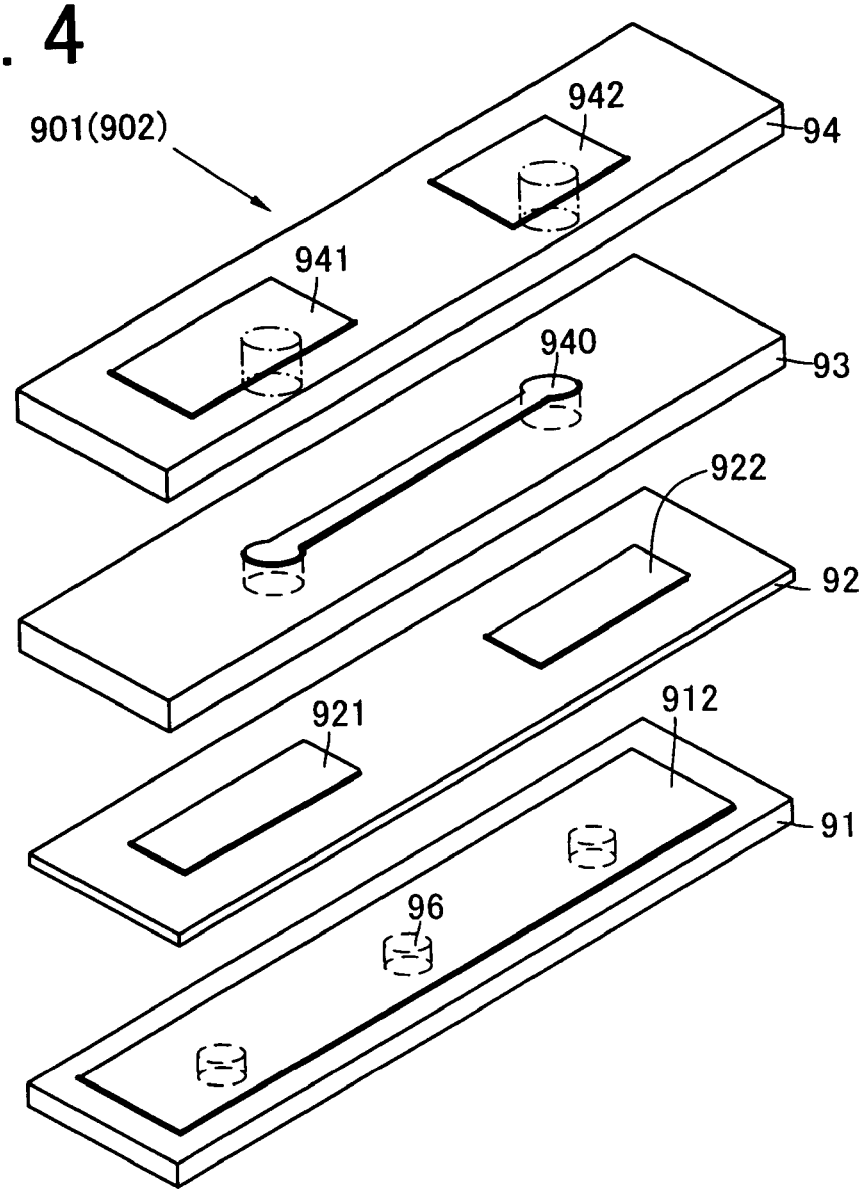
FIG. 4 is an exploded perspective view of an electric component incorporated in the inventive non-reciprocal device.
Figure 5:
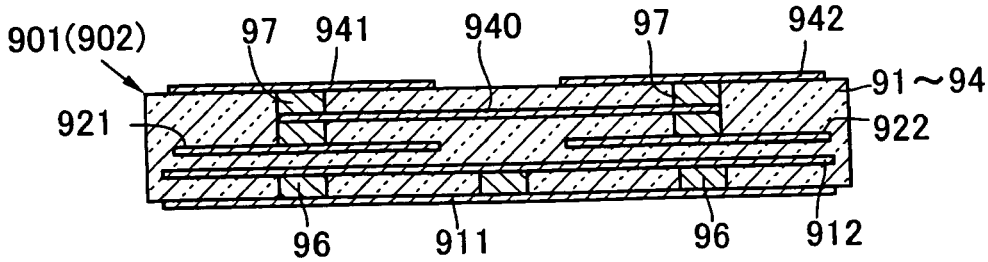
FIG. 5 is a sectional view of the electric component shown in FIG. 4.

FIG. 4 is an exploded perspective view of the electric component 901 or 902. FIG. 5 is a sectional view of the electric component 901 or 902 shown in FIG. 4. Inspection of the figures show that the ceramic substrate 9 comprises ceramic layers 91–94 each consisting of a dielectric material.

The lowermost ceramic layer 91 has ground electrodes 911, 912 on its surfaces with the two electrodes 911, 912 connected to each other via via-hole conductors 96. Over the ground electrode 912 rests a ceramic layer 92, on the top surface of which are laid capacitor electrodes 921, 922.

The capacitor electrodes 921, 922 in combination with the ground electrode 912 form the second capacitor C11 (or C12) and first capacitor C21 (or C22).

A ceramic layer 93 is laid over the capacitor electrodes 921, 922, and has a linear conductor 940 formed on its top surface which is then covered by a ceramic layer 94. On the top surface of the ceramic layer 94 there are formed input/output electrodes 941, 942. The input/output electrodes 941, 942 are connected via via-hole conductors 97 to corresponding terminal ends of the linear conductor 940 as well as to the capacitor electrodes 921, 922. The linear conductor 940 forms a distributed constant line (LC1 or LC2) including its intrinsic inductance L11 or L12 and a distributed capacitance.

As shown in FIGS. 1 and 2, the electric components 901, 902 are inserted between the terminals 311, 321 of the first and second center conductors 31, 32 on one hand and the basic ground G of enclosure member 71 on the other to be brought into contact with those circuit elements, and put under the pressure from the pressing member 8 to enhance the contact. The contact may be electrically ensured, for example, by welding.

With regard to electric component 901, one input/output electrode 941 (proximal) is connected to the terminal 311 of the first center conductor 31 while the other input/output electrode 942 (distal) is connected to an input terminal 711 via a conductor plate 731.

With regard to electric component 902, one input/output electrode 941 (proximal) is connected to the terminal 321 of the second center conductor 32 while the other input/output electrode 942 (distal) is connected to an input terminal 712 via a conductor plate 732. The ground electrodes 911 of electric components 901, 902 are connected to the basic ground G of enclosure member 71.

The electric components 903 and 904 consisting of the second capacitor C13 and terminal resistor R respectively are formed on respective chips. The equivalent inductances of the first to third center conductors 31 to 33 are represented by L01 to L03 respectively in FIG. 3.

Next, how impedance matching is achieved by the non-reciprocal device will be described.

Figure 6:
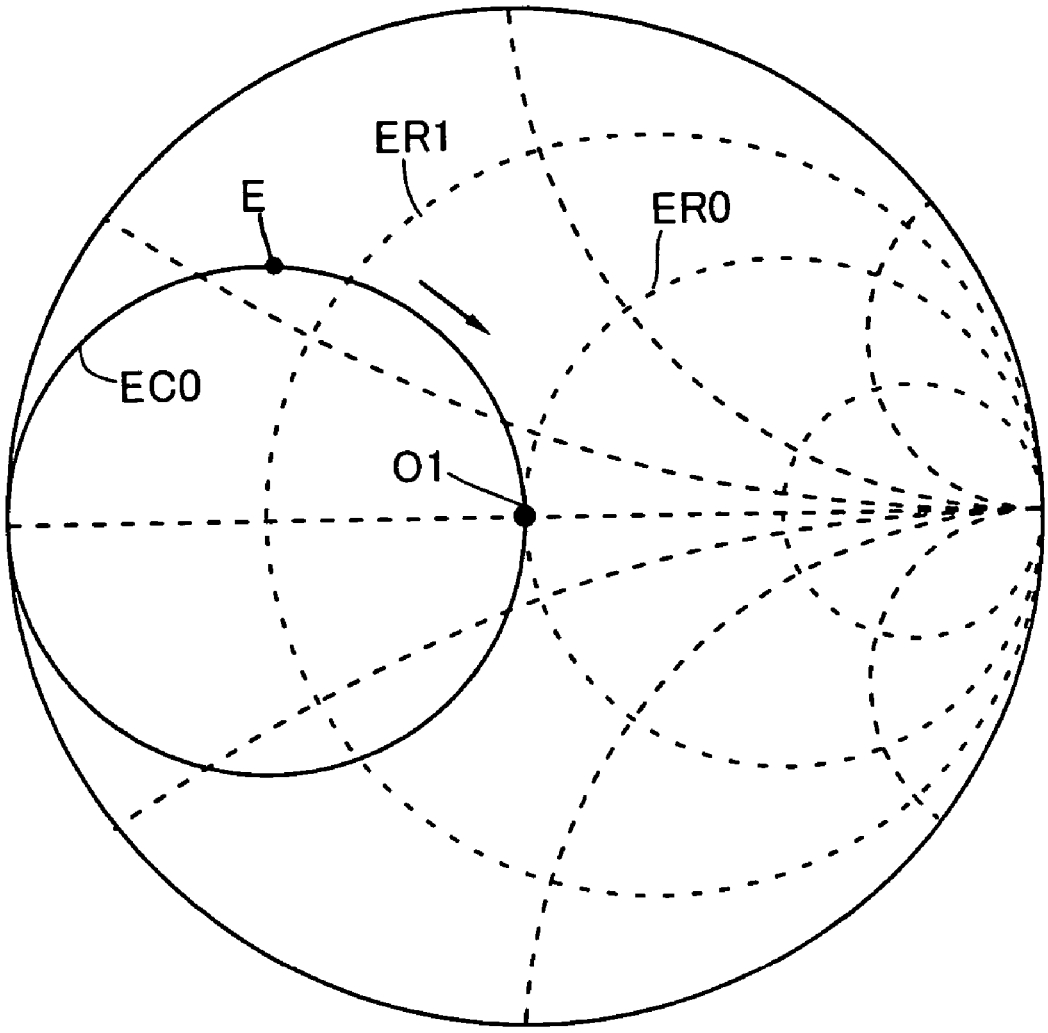
FIG. 6 is a Smith chart for illustrating an exemplary impedance matching achieved by a conventional non-reciprocal device.

FIG. 6 is a Smith chart for illustrating an exemplary impedance matching achieved by a conventional non-reciprocal device. The conventional non-reciprocal device achieves impedance matching within an operable frequency band by introducing a matching capacitor in parallel with a center conductor. Therefore, the impedance of the center conductor to which a DC magnetic field is applied is selected, after the matching capacitor is excluded and the impedance is normalized based on a characteristic impedance required for the non-reciprocal device, to take a value, for example, corresponding to point E on a constant conductance circle EC0 passing through the center O1 of the Smith chart shown in FIG. 6.

Impedance matching is achieved by attaching the matching capacitor in parallel with the center conductor. When the matching capacitor is attached in parallel with the center conductor, the impedance of the center conductor moves clockwise on the constant conductance circle EC0 towards the center O1 of the Smith chart. Thus, impedance matching is achieved by determining the capacitance of the matching capacitor which allows the impedance of the center conductor to take a value corresponding to the center O1 of the Smith chart.

Figure 7:
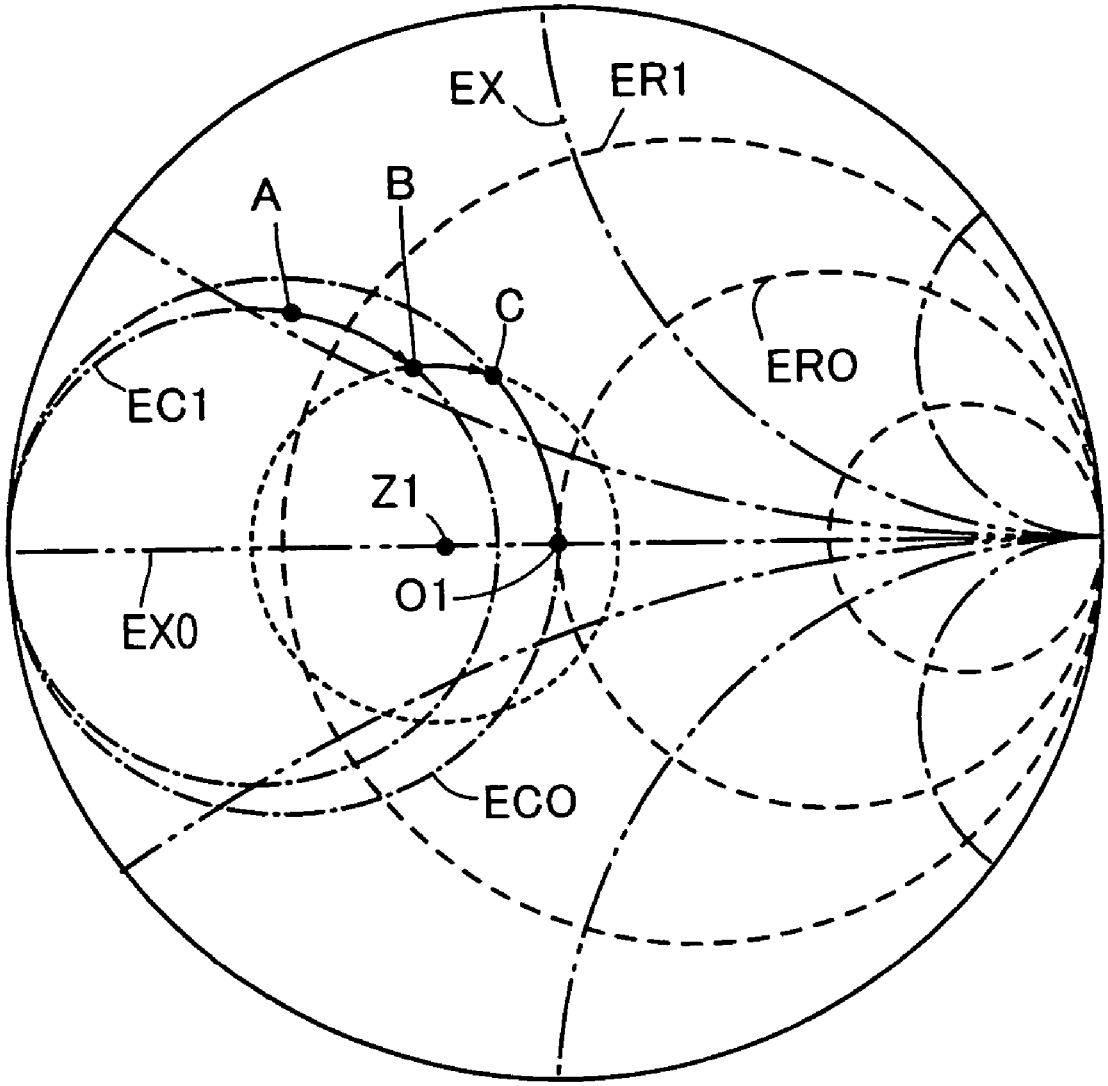
FIG. 7 is a Smith chart for illustrating an exemplary impedance matching achieved by an inventive non-reciprocal device.
Figure 8:
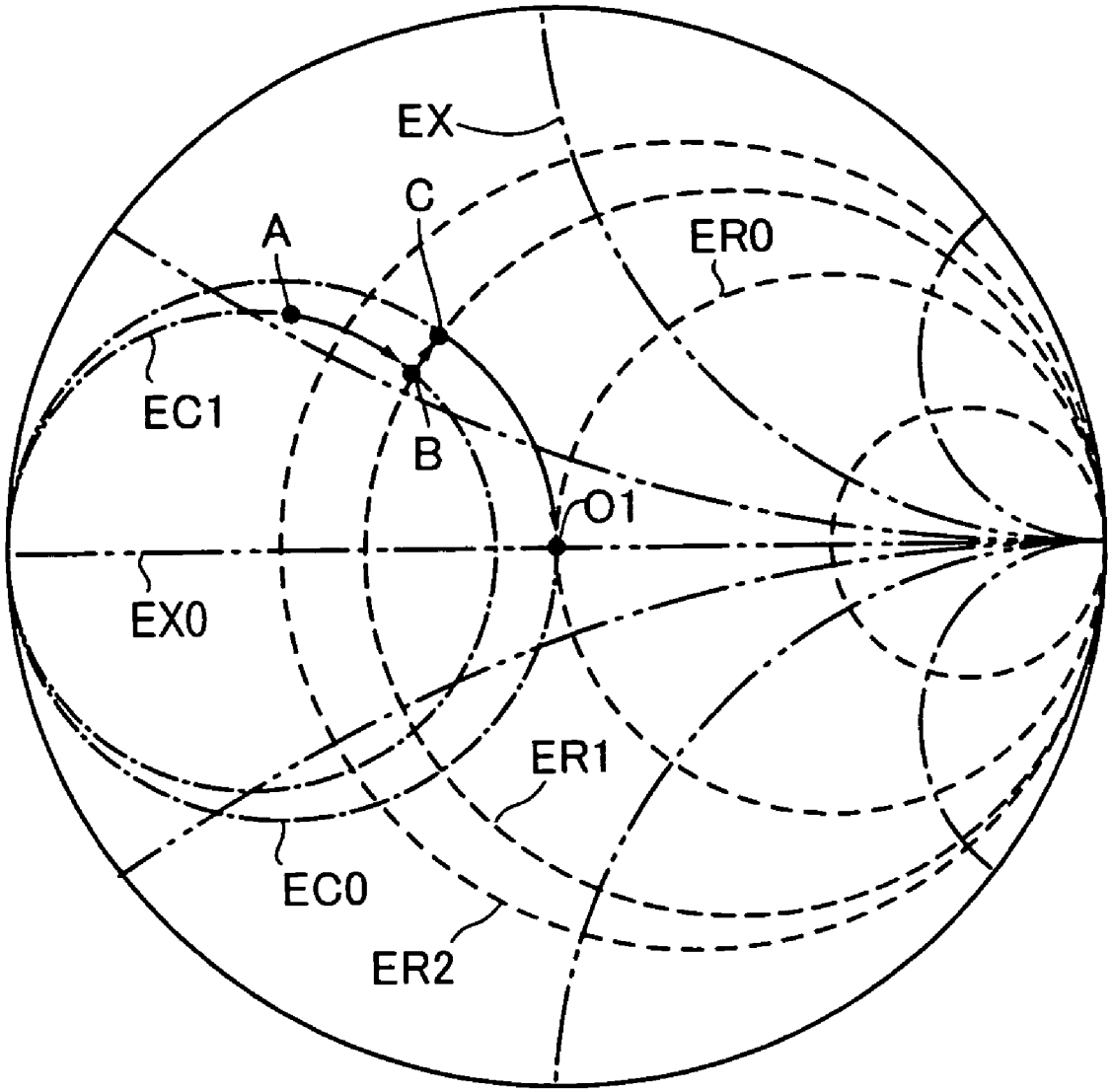
FIG. 8 is a Smith chart for illustrating an exemplary impedance matching achieved by another inventive non-reciprocal device.
Figure 9:
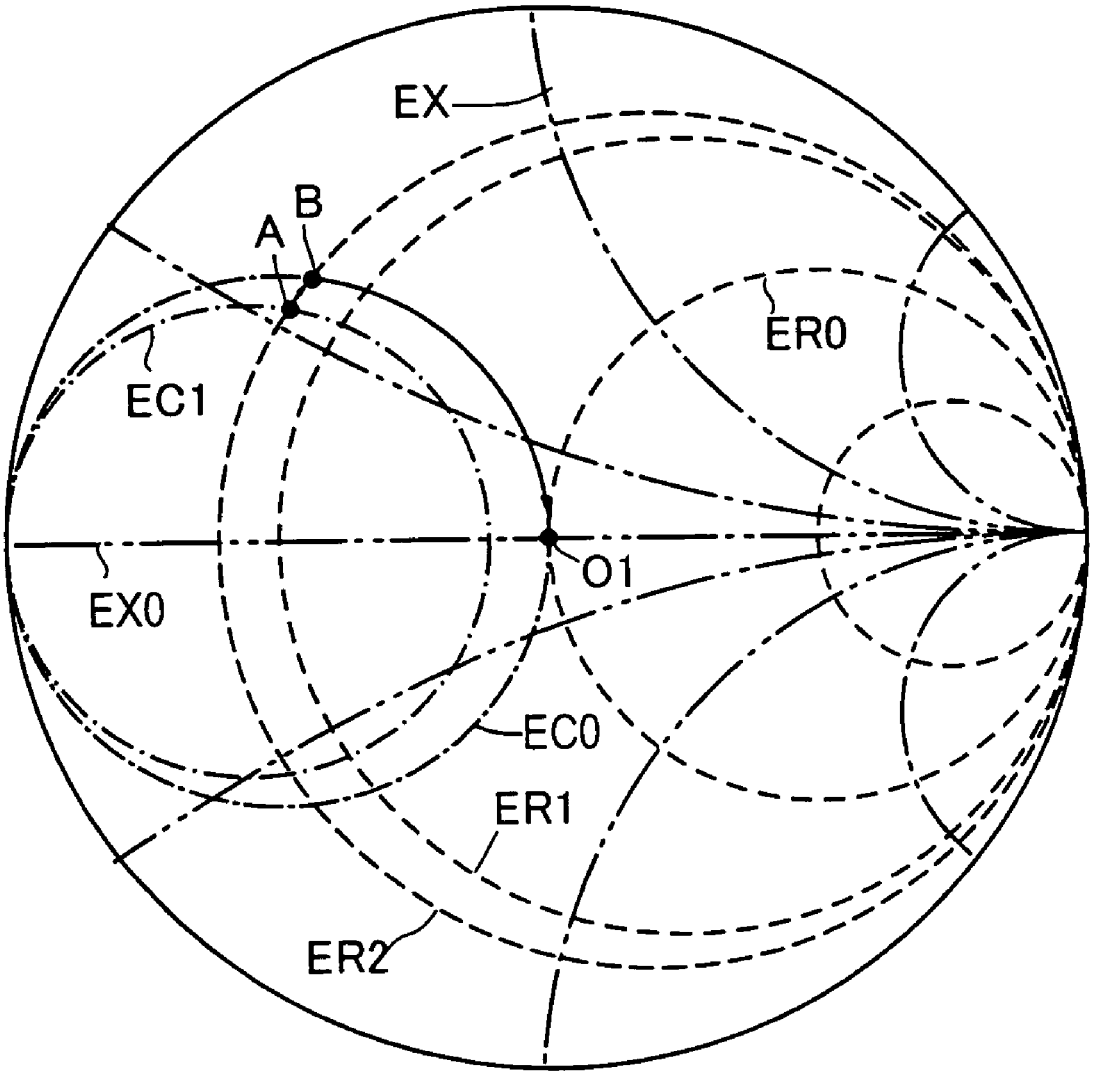
FIG. 9 is a Smith chart for illustrating an exemplary impedance matching achieved by yet another inventive non-reciprocal device.

FIGS. 7 to 9 are Smith charts for illustrating impedance matching achieved by some non-reciprocal devices embodying the invention.

First, FIG. 7 shows matching achieved by a non-reciprocal device representing an embodiment of the invention where the linear conductor 940 forms a distributed-element transmission line (LC1 or LC2) consisting of an inductance L11 or L12 and a distributed capacitance. Description will be given below on the premise that the impedances of the first and second center conductors 31, 32 are normalized based on a characteristic impedance required for the non-reciprocal device. With reference to FIG. 7, adjustment to the intensity of the DC magnetic field applied by the permanent magnet 6 allows the impedance of the first or second center conductor 31 or 32 to take a value e.g. point A which is on a constant conductance circle EC1 smaller than the constant conductance circle EC0 passing through the center O1 of Smith chart and which is on a constant reactance line above the constant reactance line EX0 passing through the center O1 of Smith chart.

From above, the impedance of the first or second center conductor 31 or 32, to which a DC magnetic field is applied, can take a value within a circular space defined by the constant conductance circle EC0 passing the center O1 of Smith chart. This means that, according to the inventive non-reciprocal circuit, it is possible to reduce the intensity of the DC magnetic field as well as inductance of the first or second center conductor 31 or 32 as compared with the conventional non-reciprocal device. Namely, it is possible according to the inventive non-reciprocal device to reduce the thickness of permanent magnet 6 and the size of soft ferrite body 4.

The first and second center conductors 31, 32 have the second capacitors C11, C12 connected in parallel thereto, respectively. When a capacitor is connected in parallel to the center conductor, the impedance of the center conductor moves clockwise on the constant conductance circle EC1. Thus, the impedance of the first or second center conductor 31 or 32 seen from the connection point of the second capacitor C11 or C12 is allowed to move clockwise on the constant conductance circle EC1 to take a value e.g. point B which is on a constant reactance line above the constant reactance line EX0 passing the center O1 of Smith chart.

The first and second center conductors 31, 32 connected to input/output terminals 711, 712 have, in addition, the inductances L11, L12 connected in series thereto. When a distributed constant line is connected in series to the center conductor, the impedance of the center conductor moves clockwise on a circle whose center is at the characteristic impedance of the distributed constant line. Thus, the impedance of the first or second conductor 31, 32 seen through the distributed constant line (LC1, LC2) is allowed to move clockwise on a circle centered at point Z1 and passing point B, and thus to take point C which is op the constant conductance circle EC0 passing the center O1 of Smith chart.

The distributed constant lines (LC1, LC2) have the first capacitors C21, C22 connected in parallel thereto, respectively. When a capacitor is connected in parallel to the center conductor, the impedance of the center conductor moves clockwise on a constant conductance circle. Thus, the impedance of the first or second center conductor 31 or 32 seen through the distributed constant line (LC1 or LC2) is allowed to move clockwise on the constant conductance circle EC0 passing the center O1 of Smith chart, and thus to take the center O1 of Smith chart. Consequently, it is possible to establish secure matching between the input and output impedances.

As seen from above, according to the inventive non-reciprocal device, it is possible to securely establish matching between input and output impedances by introducing in-parallel connected capacitors and in-series connected inductors, and thus to reduce the loss due to insertion of the matching circuit. Even if a small soft ferrite body is used, it is possible to maintain the inductance of the center conductor at a sufficiently high level, and thus it is also possible to broaden the operable frequency band. Moreover, since the capacitor connected in parallel to the center conductor is allowed to take a small capacitance, this in-parallel connected capacitor can be made small, which will further facilitate, in cooperation with the compaction of the soft ferrite body and thinning of the permanent magnet, the compaction and thinning of the non-reciprocal device at large.

Turn now to FIG. 8 which shows matching achieved by another inventive non-reciprocal device where the distributed capacitance of linear conductor 940 is negligible. Description will be given below on the premise that the impedances of the first and second center conductors 31, 32 are normalized based on a characteristic impedance required for the non-reciprocal device. With reference to FIG. 8, adjustment to the intensity of the DC magnetic field applied by the permanent magnet 6 allows the impedance of the first or second center conductor 31 or 32 to take a value e.g. point A which is on a constant conductance circle EC1 smaller than the constant conductance circle EC0 passing through the center O1 of Smith chart and which is on a constant reactance line above the constant reactance line EX0 passing through the center O1 of Smith chart.

From above, the impedance of the first or second center conductor 31 or 32, to which a DC magnetic field is applied, can take a value within a circular space defined by the constant conductance circle EC0 passing through the center O1 of Smith chart. This means that, according to the inventive non-reciprocal circuit, it is possible to reduce the intensity of the DC magnetic field as well as inductance of the first or second center conductor 31 or 32 as compared with the conventional non-reciprocal device. Namely, it is possible according to the inventive non-reciprocal device to further reduce the thickness of permanent magnet 6 and the size of soft ferrite body 4.

The first and second center conductors 31, 32 have the second capacitors C11, C12 connected in parallel thereto, respectively. When a capacitor is connected in parallel to the center conductor, the impedance of the center conductor moves clockwise on the constant conductance circle EC1. Thus, the impedance of the first or second center conductor 31 or 32 seen from the connection point of the second capacitor C11 or C12 is allowed to move clockwise on the constant conductance circle EC1 and take a value e.g. point B which is on a constant reactance line above the constant reactance line EX0 passing through the center O1 of Smith chart.

The electric components 901, 902 have inductors L11, L12 respectively, which are inserted in series between the terminals 311, 321 of the first and second center conductors 31, 32 on one hand and input/output terminals 711, 712 on the other. When the inductor L11, L12 is connected in series to the center conductor, the impedance of the center conductor moves clockwise on an equal resistance circle ER1. Thus, the impedance of the first or second conductor 31, 32 seen through the inductor L11, L12 is allowed to take point C which is on the constant conductance circle EC0 passing through the center O1 of Smith chart.

The inductors L11, L12 are connected to the first capacitors C21, C22, respectively. Connection of the first capacitor C21, C22 allows the impedance of the center conductor to move clockwise on a constant conductance circle. Thus, the impedance of the first or second center conductor 31 or 32 seen through the inductor L11, L12 is allowed to move clockwise on the constant conductance circle EC0 passing through the center O1 of Smith chart, and thus to take the center O1 of Smith chart. Consequently, it is possible to establish secure matching between input and output impedances.

Turn now to FIG. 9 which shows matching achieved by yet another inventive non-reciprocal device where not only the distributed capacitance of linear conductor 940 is ignored but also the second capacitors C11, C12 are omitted. Description will be given below on the premise that the impedances of the first and second center conductors 31, 32 are normalized based on a characteristic impedance required for the non-reciprocal device. With reference to FIG. 9, adjustment to the intensity of the DC magnetic field applied by the permanent magnet 6 allows the impedance of the first or second center conductor 31 or 32 to take a value e.g. point A which is on a constant conductance circle EC1 smaller in diameter than the constant conductance circle EC0 passing through the center O1 of Smith chart and which is on a constant reactance line above the constant reactance line EX0 passing through the center O1 of Smith chart. Namely, it is possible according to the inventive non-reciprocal device to reduce the thickness of permanent magnet 6 and the size of soft ferrite body 4.

The first and second center conductors 31, 32 have the second inductors L11, L12 connected in series thereto, respectively. When the inductor L11, L12 is connected in series to the center conductor, the impedance of the center conductor moves clockwise on the equal resistance circle ER2. Thus, the impedance of the first or second center conductor 31 or 32 seen through the inductor L11, L12 is allowed to take a value e.g. point B which is on the constant conductance circle EC0 passing through the center O1 of Smith chart.

To the inductors L11, L12 are connected in parallel the first capacitors C21, C22, respectively. In-parallel connection of a capacitor allows the impedance of the center conductor to move clockwise on a constant conductance circle. Thus, the impedance of the first or second center conductor 31 or 32 seen through the inductor L11, L12 is allowed to move clockwise on the constant conductance circle EC0 passing through the center O1 of Smith chart, and thus to take the center O1 of Smith chart. Consequently, it is possible to establish secure matching between input and output impedances.

According to this embodiment, it is also possible to provide a non-reciprocal device which can reduce the loss due to its insertion, is small in size and thickness, and is operable over a wide frequency band.

The permanent magnet 6 incorporated in the inventive non-reciprocal device has a thickness of 0.5 mm. The first and second capacitors incorporated in the electric components 901, 902 have the capacitances of 3.7 and 4.4 pF respectively whose sum is 8.1 pF. A typical conventional non-reciprocal device incorporates a permanent magnetic element 6 having a thickness of 0.6 mm, and requires a capacitance of 10.5 pF for operating over the same frequency band. Thus, it is possible according to the present invention to obtain a non-reciprocal device being smaller in size and thickness as compared with the equivalent conventional non-reciprocal device.

Figure 10:
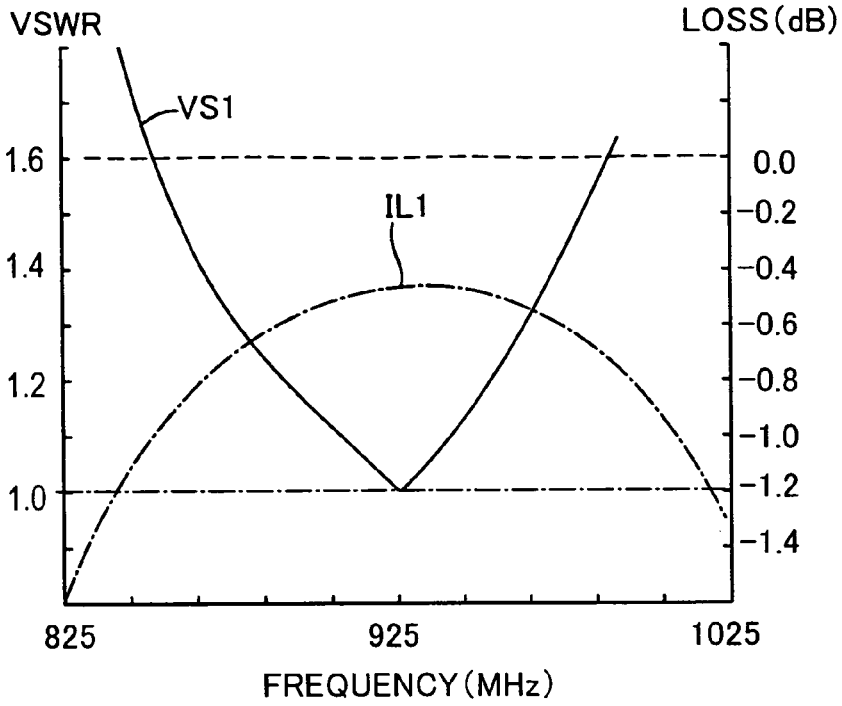
FIG. 10 shows the voltage standing wave ratio (VSWR) and insertion loss of an inventive non-reciprocal device plotted as a function of frequency (F).
Figure 11:
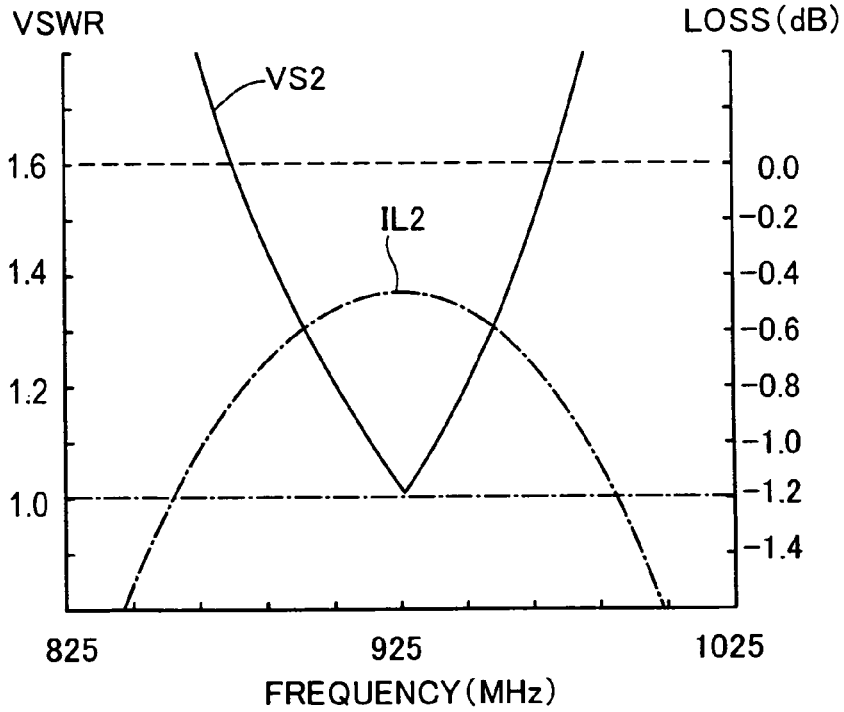
FIG. 11 shows the voltage standing wave ratio (VSWR) and insertion loss of a conventional non-reciprocal device plotted as a function of frequency (F).

FIG. 10 shows the changes of voltage standing wave ratio (VSWR) and insertion loss of an inventive non-reciprocal device as a function of frequency (F). FIG. 11 shows the corresponding changes of a conventional non-reciprocal device. In the figures, VS1 and VS2 represent the voltage standing wave ratios (VSWR) and IL1 and IL2 the insertion losses of the above-described circuit elements.

When the graphs of FIG. 10 are compared with the corresponding graphs of FIG. 11, it is recognized that the inventive non-reciprocal device exhibits lower VSWR and insertion loss over a wide frequency range than the equivalent conventional circuit element. This suggests that it is more readily possible according to the invention to produce a non-reciprocal device having a wide operable frequency band.

As seen from above, according to the present invention it is possible to provide a non-reciprocal device which is accompanied with a low insertion loss, is small in size and thickness, and has a wide operable frequency band.

Some preferred embodiments of the invention have been detailed above. However, the present invention is not limited to those embodiments, and obviously those skilled in the art could contemplate various modifications based on the teachings disclosed herein or the technical concept underlying the present invention without departing from the scope of the invention that is defined by the appended claims.

What is claimed is:

1. A non-reciprocal device comprising a gyromagnetic component, a permanent magnet and at least two LC circuits, wherein:

the gyromagnetic component comprises a soft ferrite body and a plurality of center conductors combined with the soft ferrite body;

the permanent magnet applies a DC magnetic field to the gyromagnetic component, the intensity of the DC magnetic field adjusted such that, in a Smith chart where the center represents the normalized impedance, the impedance of the gyromagnetic component is positioned at a value which is on a constant conductance circle smaller than a reference constant conductance circle passing the center and which is on a constant reactance line above a reference constant reactance line passing the center; and the LC circuits are provided for each of the at least two center conductors, and each of the LC circuits comprises;

an inductor connected in series with the center conductor, one end of the inductor connected to a terminal of the center conductor, such that in the Smith chart, the impedance of the gyromagnetic component seen from the other end of the inductor is positioned at a value which is on the reference constant conductance circle; and a first capacitor connected, in parallel with the center conductor, to the other end of the inductor such that in the Smith chart, the impedance of the gyromagnetic component seen through the inductor from the connection point of the first capacitor is moved from the value positioned by the inductor, clockwise on the reference constant conductance circle and is positioned at a value which is on the center.

2. The non-reciprocal device of claim 1, further comprising a plurality of second capacitors, wherein:

each of the second capacitors is connected, in parallel with each of center conductors, to a terminal of the center conductor such that in the Smith chart, the impedance of the gyromagnetic component seen from the connection point of the second capacitor is moved clockwise on a constant conductance circle and is positioned at a value which is on a constant reactance line above the reference constant reactance line.

3. The non-reciprocal device of claim 1, wherein:

each of the LC circuits is formed of a distributed constant line.

4. The non-reciprocal device of claim 1, wherein:

each of the LC circuits comprises a low temperature co-fired ceramic substrate.

* * * * *